US006507313B1

(12) United States Patent
Rougas

(10) Patent No.: US 6,507,313 B1
(45) Date of Patent: Jan. 14, 2003

(54) REFLECTOR RADAR ANTENNA USING FLANKING-BEAM ARRAY SWITCHING TECHNIQUE

(75) Inventor: John A. Rougas, Liverpool, NY (US)

(73) Assignee: Lockheed Martin Corporation

( * ) Notice: Subject to any disclaimer, the term of this patent is extended or adjusted under 35 U.S.C. 154(b) by 0 days.

(21) Appl. No.: 09/742,620

(22) Filed: Dec. 21, 2000

Related U.S. Application Data

(60) Provisional application No. 60/172,964, filed on Dec. 21, 1999.

(51) Int. Cl.[7] ..... H01Q 3/26
(52) U.S. Cl. ..... 342/368; 343/771
(58) Field of Search ..... 342/368, 372, 342/373, 374; 343/770, 771

(56) References Cited

U.S. PATENT DOCUMENTS

| | | | | |
|---|---|---|---|---|
| 4,675,681 A | | 6/1987 | Kinsey | 342/372 |
| 4,814,779 A | | 3/1989 | Levine | 343/754 |
| 5,192,954 A | * | 3/1993 | Brockelsby et al. | 342/42 |
| 5,223,846 A | | 6/1993 | Campbell | 342/372 |
| 5,805,114 A | * | 9/1998 | Podger | 343/742 |
| 6,111,542 A | | 8/2000 | Day et al. | 342/359 |

* cited by examiner

*Primary Examiner*—Theodore M. Blum
(74) *Attorney, Agent, or Firm*—Duane Morris LLP

(57) ABSTRACT

A radar tracking antenna system including: a parabolic-cylinder reflector; and, a subset of Flanking Beam Array Steered Technique (FAST) line feeds coupled to the reflector as a feed assembly.

9 Claims, 6 Drawing Sheets

EIGHT-ELEMENT, EIGHT-BEAM MATRIX

REFLECTOR RADAR ANTENNA USING FLANKING-BEAM ARRAY SWITCHING TECHNIQUE

RELATED APPLICATION

This application claims priority of U.S. patent application Ser. No. 60/172,964, entitled FLANKING BEAM ARRAY STEERED TECHNIQUE, filed Dec. 21, 1999, the entire disclosure of which is hereby incorporated by reference.

FIELD OF THE INVENTION

The present invention relates generally to radar antennas, and particularly reflector radar antennas.

BACKGROUND OF THE INVENTION

The use of Flanking-beam Array Switching Technique (FAST) in combination with a phased array radar antenna is generally well known. Phased array antennas include multiple radiating elements, such as slots. These elements are typically configured in a planar construction and are individually controllable in phase and amplitude. U.S. Pat. No. 4,675,681, entitled "ROTATING PLANAR ARRAY ANTENNA", issued Jun. 23, 1987 to Richard Kinsey (the '681 patent), teaches one such antenna. The entire disclosure of the '681 patent is hereby incorporated by reference herein.

FIG. 1A illustrates one face of a dual face FAST (Flanking-beam Array Switching Technique) antenna system of the type for use, for example, on ships according to the '681 patent. The antenna 20 includes a pair of arrays 22, 24 each having a plurality of waveguides 26 arranged in parallel fashion and extending generally horizontally. Each array is made up of a plurality of slotted waveguides, preferably made of rectangular, thin walled aluminum. The waveguides may be supported by a grid of vertical 28 and horizontal 30 rectangular structural tubes. The waveguides are mechanically fastened to the vertical tubes 28 which are supported by the horizontal tubes 30. The horizontal tubes are mounted upon a dual A-frame structure 32 fabricated from structural aluminum I-beams. Each array is shown mounted in a tiltback angle of approximately 20 degrees relative to the vertical axis 34 of the support structure 32. An azimuth motor 38 is mounted upon the support structure to drive the antenna in azimuthal rotation. Roll motors, one of which is shown at 40, stabilize the antenna about the roll axis which is perpendicular to axis 34, by controlling the ballscrew assembly 42, using roll position signals provided from the ship's gyro repeater (not shown). A housing 43 provides environmental protection for the antenna components located at each end of each array. A radome 60 comprising a planar sheet of epoxy glass or a similar material resistant to weather damage and transparent to the RF signals transmitted by the antenna is attached to the aperture face.

FIG. 1B illustrates a schematic view of a bi-directional FAST feed system suitable for use with the antenna of FIG. 1A. A pair of adjacent waveguides 100, 102 are shown schematically as having slots 104, 106, respectively, offset by one-half the slot spacing. An excitation source 108 is connected to one end of each of the waveguides and coupled through phase shifters 110, 112 to supply phase controlled power to each of the respective waveguides. The excitation source 108 is. also connected to hybrid load 118. An excitation source 126 is coupled through phase shifters 128, 130 to waveguides 100, 102, respectively, and is connected to hybrid load 132.

Using the bi-directional feed, two beams 120, 122 (FIG. 1C) can be formed simultaneously from one slotted waveguide 100 when excited using excitation source 108. The excitation source 126 produces a pair of beams 134, 136 (FIG. 1C) at the mirror image positions of the beams 120, 122 produced by source 108. Thus, as is illustrated in FIG. 1C, a total of four possible flanking beams for each array aperture are generated. Each of the beams can be electronically scanned in elevation by computer control of the phase shifters to provide surveillance of an area from 0 to 60 degrees or more in elevation with each rotation of the aperture.

There are known applications for radar antennas and systems which require relatively small and relatively low-cost packages. However, a realized drawback of a FAST antenna system is their relative bulkiness and undesirable high cost. Accordingly, it is an object of the present invention to provide a relatively low-cost and compact antenna system utilizing the FAST.

SUMMARY OF THE INVENTION

A radar tracking antenna system including: a parabolic-cylinder reflector; and, a subset of Flanking Beam Array Steered Technique (FAST) line feeds coupled to the reflector as a feed assembly.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not necessarily to scale.

DETAILED DESCRIPTION OF A PREFERRED EMBODIMENTS

According to an aspect of the present invention, a subset of Flanking Beam Array Steered Technique (FAST) line feeds and their associated phase shifters, being utilized as the feed assembly, is applied to a reflector antenna. According to another aspect of the present invention the subset of line feeds includes 8 rows, or 4 pairs, of FAST line feeds.

Figure 1A:
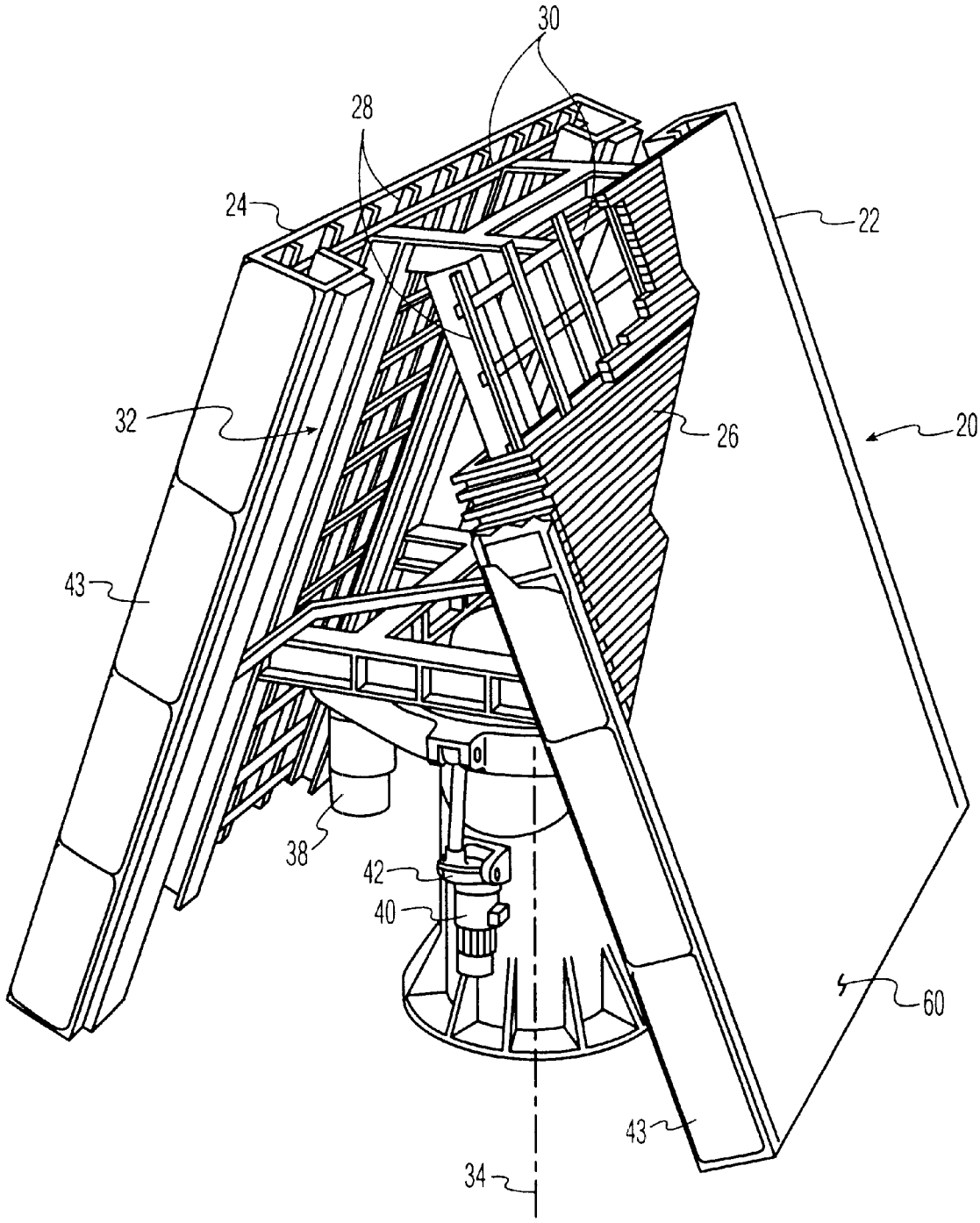
FIG. 1A PRIOR ART
FIG. 1A illustrates an oblique view of a prior art planar array antenna.
Figure 1B:
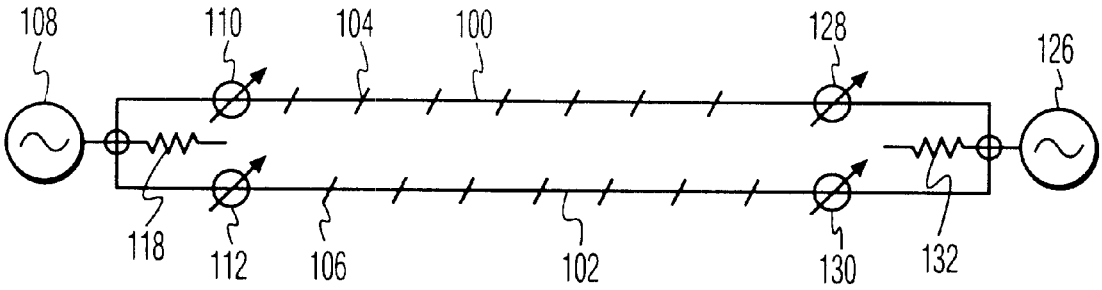
FIG. 1B PRIOR ART
FIG. 1B illustrates a schematic circuit diagram of a bidirectionally fed, staggered row pair of waveguides suitable for use with the antenna of FIG. 1A.
Figure 1C:
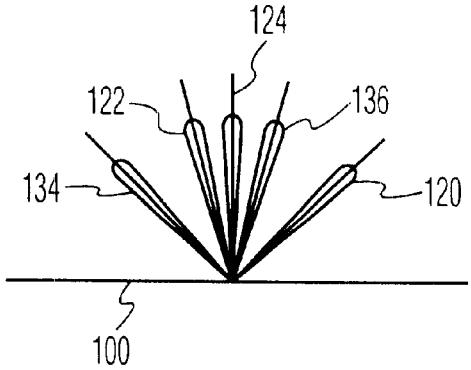
FIG. 1C PRIOR ART
FIG. 1C illustrates a plot of the output beams produced by a single row of waveguides excited as illustrated in FIG. 1B.
Figure 2:
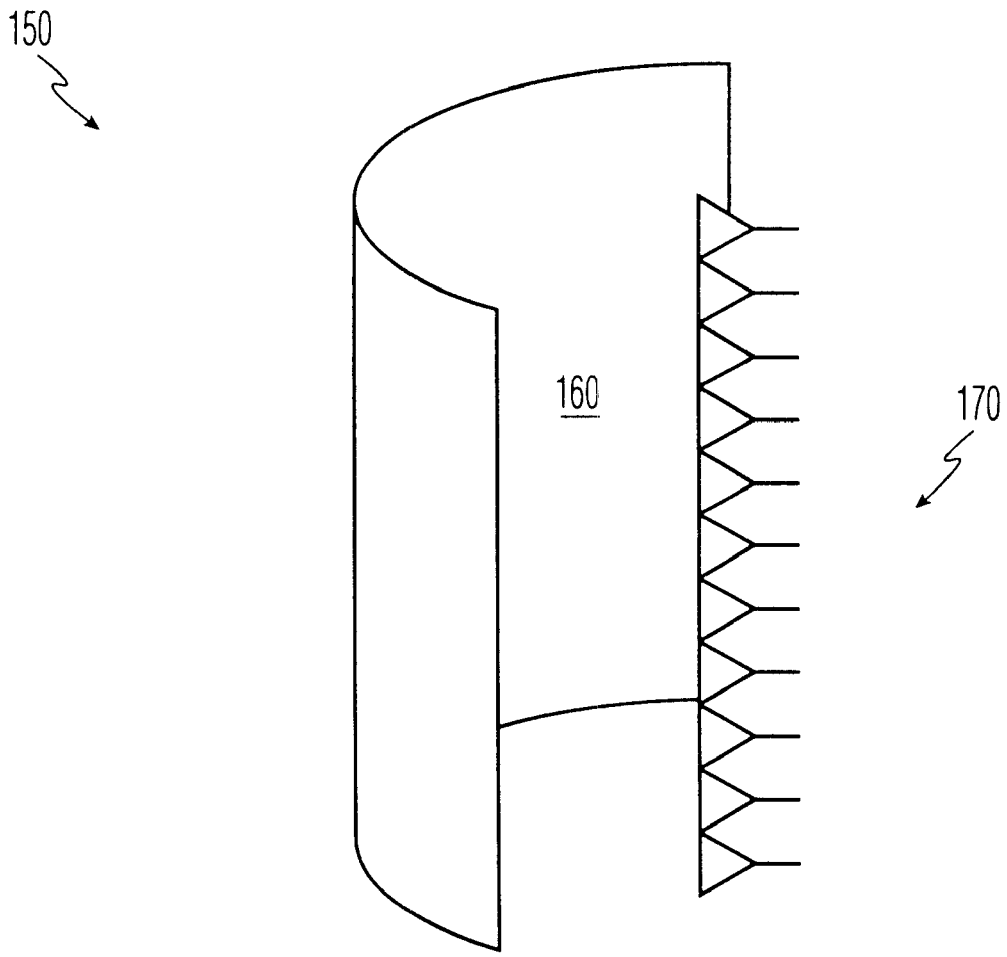
FIG. 2 PRIOR ART
FIG. 2 illustrates a conventional parabolic-cylinder radar antenna.

According to another aspect of the present invention, the reflector antenna is a parabolic cylinder reflector antenna. Parabolic cylinder reflector antennas are generally well known. Referring now to FIG. 2, there is shown a representation of a parabolic cylinder reflector antenna 150. The internal surface 160 of the parabolic cylinder reflector is illuminated by a source 170. Parabolic cylinder reflector antennas collimate radiation in a single plane. This allows for beam-steering or beam-shaping of either a resulting elevation or azimuth beam as is conventionally understood. In a conventional parabolic cylinder reflector antenna the line source can take the form of a parallel plate lens, slotted-waveguide or phase array for example.

According to another aspect of the present invention, the small array of line feeds and phase shifters is offset from the parabolic cylinder reflector to maintain very low azimuth side-lobe performance of the FAST row feeds. Because of the use of FAST line feeds, advantageously, up to four beams (FIG. 4B) can be formed in azimuth from the antenna aperture. In addition, two beams can be formed simultaneously in azimuth. Further, each of the beams formed in azimuth can be independently steered in elevation. Further yet, each of the azimuth beams can be frequency steered in azimuth. The FAST feed output may also be collimated to form multiple beams in elevation. Further, the output collimated multiple beams can be phase-steered in elevation. Finally, the present invention allows for elevation monopulse operation using the collimated beams.

Figure 3:
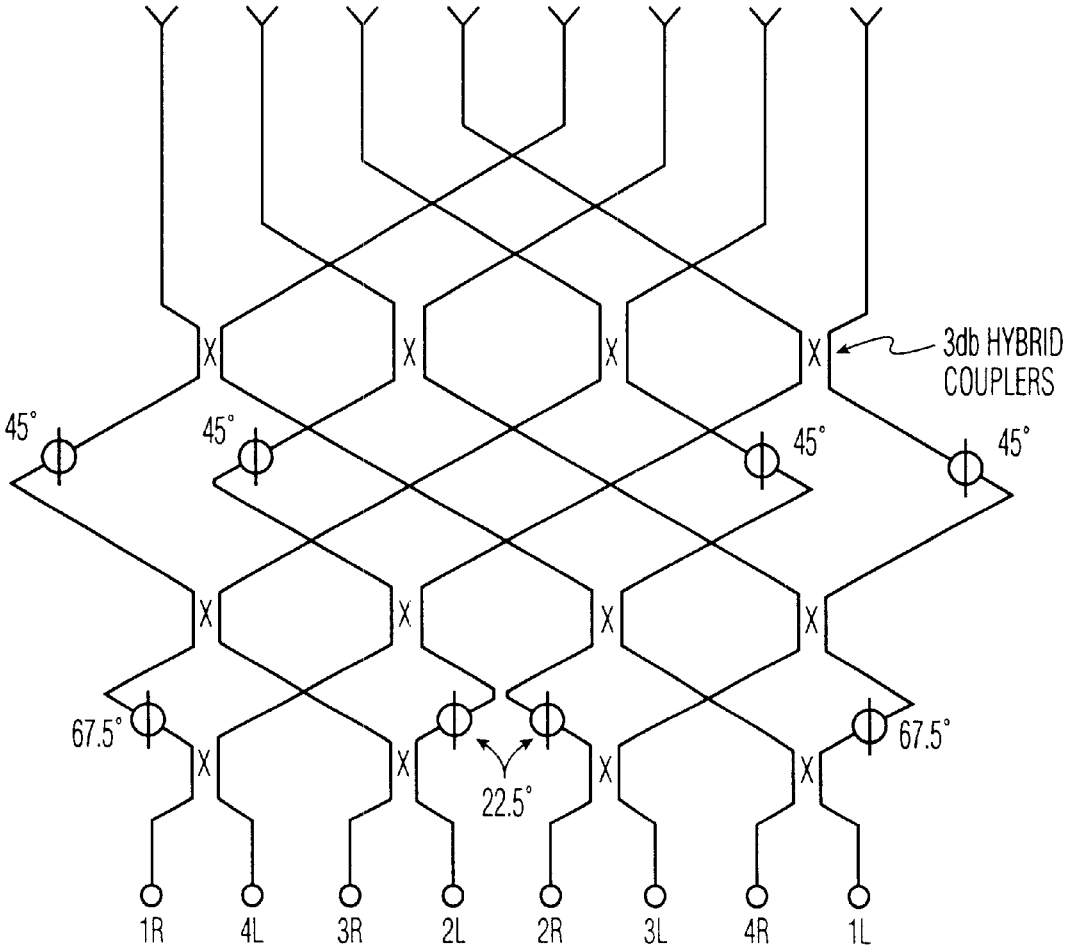
FIG. 3 PRIOR ART
FIG. 3 schematically illustrates an eight-element, eight-beam Butler Matrix that can be used to generate Flanking Beam Array Steered Technique (FAST) feeds.

Referring now also to FIG. 3, there is shown a schematic illustration of an 8 element elevation combiner in the form of a known eight-element, eight-beam Butler Matrix that can be used to generate Flanking Beam Array Steered Technique (FAST) feeds. Butler matrixes are well known for producing multiple beams in general. Each of the terminals 1R, 4L, 4R, 2L, 2R, 3L, 4R and 1L are coupled to an individual one of the row elements, or half-height sticks.

Figure 4A:
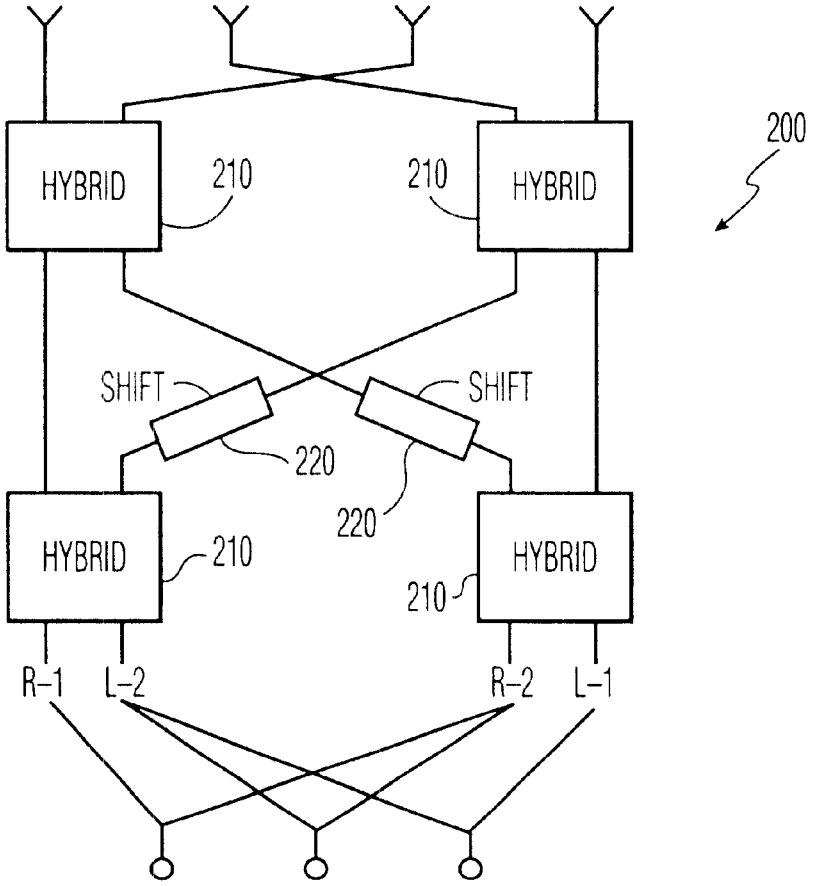
FIG. 4A illustrates a block diagram of a system for multiple beam-forming using Flanking Beam Array Steered Technique (FAST) feeds that can be utilized according to an aspect of the present invention.
Figure 4B:
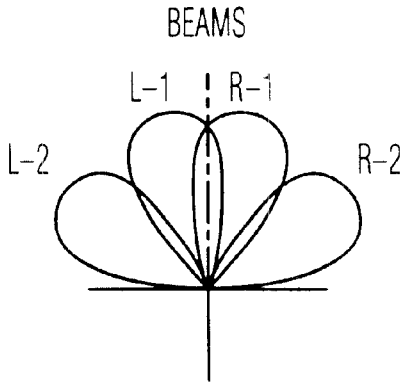
FIG. 4B illustrates an elevational-view of resulting beams generated in azimuth using the system of FIG. 4A.

Referring now also to FIG. 4A, there is shown a block diagram of a 4 element elevation combiner system 200 for multiple beam-forming from Flanking Beam Array Steered Technique (FAST) feeds that can be utilized according to another aspect of the present invention. The system 200 is suitable for use where the feeds are pre-combined using a configuration such as is illustrated in FIG. 2 for example. The system 200 includes four 90° lagging hybrids 210. The hybrids are cross-coupled using 45° lagging phase shifters 220. Beams generated using the system 200 are shown in FIG. 4B as beams L-2, L-1, R-1 and R-2. Like references in FIGS. 4A and 4B identify like beams.

Figure 5A:
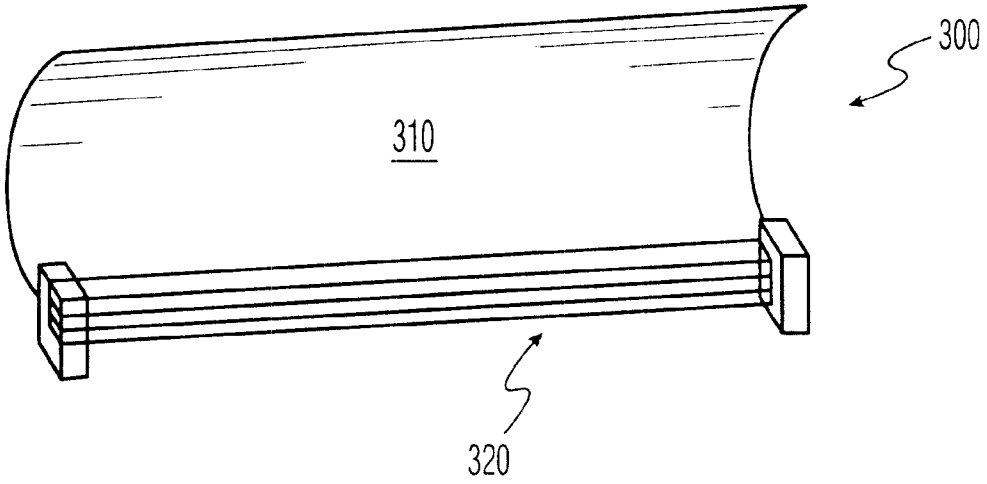
FIG. 5A illustrates a perspective view of a radar antenna system according to an aspect of the present invention; and, FIG. 5B illustrates a cross-section of the radar antenna system of FIG. 5A.
Figure 5B:
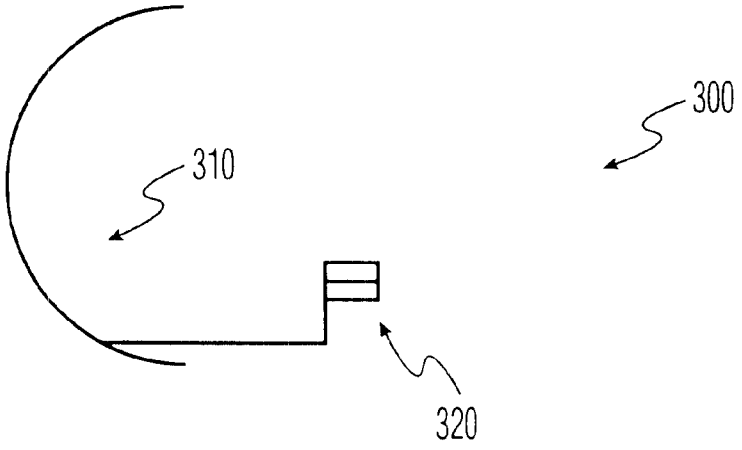

Referring now to FIGS. 5A and 5B, there are shown perspective and cross-section views of a radar system 300 according to an aspect of the invention. The system 300 includes parabolic cylinder reflector 310 and feed assembly 320. The feed assembly 320 in FIGS. 5A and 5B provides FAST feeds, as has been discussed with regard to FIGS. 2, 3 and 4A, for illuminating the reflector 310. It should be understood that while the feed assembly 320 in FIGS. 5A and 5B is illustrated to only include two half-height sticks, or a single row pair of waveguides, for sake of simplicity, preferably 4 pairs of waveguides, or 8 half-height sticks, are used.

According to another aspect of the present invention, one or more simple horn feeds can be used to apply the excitation signal to the reflector. In such a case, again the FAST feed output can be collimated to form multiple beams in elevation as is understood through the application of conventional FAST feed techniques. Further, the output collimated multiple beams can be phase-steered in elevation. And, elevation monopulse operation is possible with the collimated beams. It should be noted that in contrast to simple horn feeds, preservation of multiple steerable beams at each of the up to four beam positions in azimuth can be achieved according to an aspect of the present invention.

Due to the inclusion of FAST feeds, realized advantages of the present invention include placing a target on track within a single azimuth scan as four beams in azimuth can be used per rotation. This provides a user with up to three times the alerting/warning time over a conventional radar not using the FAST-fed reflector technique and extends weapons systems effectiveness according to another aspect of the present invention.

Further, ECCM performance of radar systems using the technique is improved by virtue of the very low azimuth sidelobes provided by the FAST row feeds, and the azimuth scan-back, provided naturally by the FAST feeds which allow jammer burn-through over 3–6 azimuth beamwidths.

An antenna system according to the present invention further includes the ability to adapt dynamic clutter, such as weather or chaff, within a single azimuth scan, as again multiple beams are provided in azimuth which can revisit cluttered azimuth cells with new weight sets and Pulse Repetition Frequencies (PRF's).

Further yet, according to another aspect of the present invention, the ability to adjust the elevation of the transmitted and received beams electronically as a function of azimuth allows for terrain following search patterns which prevent coverage holes due to terrain depressions and improved detection performance close to the horizon.

Finally, according to yet another aspect of the present invention high performance 3-D operation at low cost from the collimated feed output due to the simplicity of the FAST feed and low number of phase shifters is realized.

In summation, the present invention provides the advantages of a small, tactically mobile, high capacity reflector antenna with the capabilities of a more costly and bulky conventional FAST antenna.

Although the invention has been described and pictured in a preferred form with a certain degree of particularity, it is understood that the present disclosure of the preferred form, has been made only by way of example, and that numerous changes in the details of construction and combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A radar antenna system comprising:

a parabolic cylindrical reflector; and, a feed assembly for supplying line feeds to illuminate said reflector using a plurality of Flanking Beam Array Steered Technique (FAST) line feeds, wherein said feed assembly comprises at least one hybrid, and wherein said feed assembly is offset from the radiation axis of said parabolic cylindrical reflector for maintaining low azimuth performance for said line feeds.

2. The antenna system of claim 1, where said feed assembly comprises at least one phase shifter.

3. The antenna system of claim 1, wherein said at lease one hybrid introduces a 90° lag.

4. The antenna system of claim 2, wherein said at lease one phase shifter introduces a 45° lag.

5. The antenna system of claim 1, where said feed assembly comprises a plurality of phase shifters.

6. The antenna system of claim 5, wherein said feed assembly further comprises a plurality of hybrids.

7. The antenna system of claim 1, wherein said plurality of line feeds corresponds to 8 rows, or 4 pairs of FAST feeds.

8. A radar antenna comprising:

a parabolic cylinder reflector; and, an array for illuminating said reflector, said array comprising:

a plurality of elongated rectangular waveguides disposed in parallel relationship having uniformly spaced slots in one edge thereof and having one planar edge of each of said waveguides aligned to form a planar array; adjacent ones of said waveguides being disposed such that said slots of a first waveguide are offset from the slots of an adjacent waveguide;

bidirectional feed means for supplying input signals from opposite ends of each of said waveguides via Flanking Beam Array Steered Technique (FAST) line feeds; and switching means for phase switching input signals supplied to said adjacent waveguides by said bidirectional feed means to produce four distinct output beams from said planar array, wherein said array including said bidirectional feed means is offset from the radiation axis of the parabolic cylinder reflector for maintaining low azimuth side-lobe performance of the FAST line feeds.

9. A radar antenna system comprising:

a parabolic cylindrical reflector; and, a feed assembly for supplying line feeds to illuminate said parabolic cylindrical reflector using a plurality of Flanking Beam Array Steered Technique (FAST) line feeds, wherein said feed assembly is offset from the radiation axis of said parabolic cylindrical reflector for maintaining low azimuth performance for said line feeds.

* * * * *